US012478827B2

(12) United States Patent
Daily

(10) Patent No.: US 12,478,827 B2
(45) Date of Patent: Nov. 25, 2025

(54) APPARATUS AND METHODS FOR SUPPORT

(71) Applicant: Daily Products, Inc., Los Angeles, CA (US)

(72) Inventor: Michael David Daily, Los Angeles, CA (US)

(73) Assignee: DAILY PRODUCTS, INC., Los Angeles, CA (US)

( * ) Notice: Subject to any disclaimer, the term of this patent is extended or adjusted under 35 U.S.C. 154(b) by 193 days.

(21) Appl. No.: 18/497,769

(22) Filed: Oct. 30, 2023

(65) Prior Publication Data

US 2025/0135265 A1 May 1, 2025

(51) Int. Cl.
*A63B 21/00* (2006.01)

(52) U.S. Cl.
CPC ..... *A63B 21/4033* (2015.10)

(58) Field of Classification Search
CPC ..... A63B 21/00047; A63B 21/4039; A63B 23/00; A63B 2023/006
See application file for complete search history.

(56) References Cited

U.S. PATENT DOCUMENTS 5,716,305 A * 2/1998 Selsam ..... A63B 21/00047 482/52
7,922,624 B1 * 4/2011 Fairhurst ..... A63B 21/0552 482/52
D740,378 S * 10/2015 Walsh-Gomez ..... D21/662
D837,313 S * 1/2019 Lyons ..... D21/662
10,315,064 B2 * 6/2019 Pinkus ..... A63B 23/03541
D928,893 S * 8/2021 Razon ..... D21/686
D949,260 S * 4/2022 Lan ..... D21/686
2009/0247378 A1 * 10/2009 Carlesimo ..... A63B 21/00047 482/141
2010/0240509 A1 * 9/2010 Chen ..... A63B 21/00047 482/148
2012/0329623 A1 * 12/2012 Ramirez ..... A63B 21/00047 482/139
2017/0065845 A1 * 3/2017 Pinkus ..... A63B 21/4035
2018/0256940 A1 * 9/2018 Lyons ..... A63B 26/003

* cited by examiner

*Primary Examiner* — Andrew M Kobylarz
(74) *Attorney, Agent, or Firm* — Whitestone Law, PLLC

(57) ABSTRACT

Some of the embodiments are therefore directed to an apparatus configured for assisting a human user to perform yoga. The apparatus includes a block formed unitarily of a material that is subject to compression during use, with the block including a rectangle in cross-section. The block includes top and bottom opposing surfaces, front and rear opposing surfaces, and opposing side surfaces. The opposing side surfaces each have a length that is substantially the same as a length of the top and bottom surfaces and a height that is substantially the same as a height of the front and rear surfaces. The length of the top, bottom, and side surfaces are longer than the height of the front, rear, and side surfaces. One of the opposing side surfaces defines an aperture that opposes an aperture of the other of the side surfaces, the apertures extending partially into an interior of the block to a length so as to not form a contiguous aperture.

18 Claims, 6 Drawing Sheets

APPARATUS AND METHODS FOR SUPPORT

BACKGROUND

Some embodiments are directed to an apparatus and methods for support. Some of these embodiments are directed to such an apparatus and methods for supporting human users. Some of these embodiments are directed to such an apparatus and methods for supporting human users to perform certain activities, such as yoga and other exercises.

Yoga and other exercises can involve human users using various positions and/or moving their bodies in certain ways. It can be helpful during these exercises and body positions for a user to use a support apparatus.

SUMMARY

In the context of humans engaging in certain activities, such as energetic activities including but not limited to yoga and other exercises, human users can assume various positions or perform certain body movements.

Thus, it may be beneficial to use a support apparatus. In this context, it may be beneficial to provide a support block. It may further be beneficial to provide a compressible support block that a human user finds relatively easy to use. Some embodiments can provide other benefits, such as being relatively efficient and cost effective to manufacture, being relatively easy to grip, and/or being relatively durable.

Some embodiments disclosed here are directed to a support that can facilitate a human user doing yoga and other exercises. Some of the supports can include blocks that are compressible when the user applies pressure, such as when the user rests on or presses the support directly or indirectly.

The support block can have the shape of a rectangular cuboid with top and bottom opposing surfaces, front and rear opposing surfaces, and opposing side surfaces. The opposing side surfaces can have stadium-shaped apertures extending into the interior of the block.

The sides of the block can form chamfered edges to reduce the angularity of each edge, providing additional comfort and safety.

The opposing side surfaces can have a length that is substantially the same as a length of the top and bottom opposing surfaces.

The opposing side surfaces can have a height that is substantially the same as a height of the front and rear opposing surfaces.

The front and rear opposing surfaces can have a width that is substantially the same as a width of the top and bottom opposing surfaces.

The length, height, and width of the block can be different lengths from one another.

The length of the block can be longer than the height of the block.

The length of the block can be longer than the width of the block.

The width of the block can be longer than the height of the block.

The apertures can be centered on their opposing side surfaces, can extend partially into an interior of the block, and do not form a contiguous aperture. The apertures can be stadium-shaped and can be arcuate at each end, making them more comfortable to grip.

The block can act as a support apparatus for performing yoga and other exercises, providing more comfortable positions than doing the exercises without a support platform.

The size of the block can provide benefits which can include but are not limited to a wide surface area for supporting a human user's body and comfortable hand positioning upon a human user holding the block using the apertures.

The larger size of the block can make the block more usable by a wide range of human users. The block can support more weight with its size and wide surface area.

The cuboidal shape of the block can allow it to be placed on any flat surface, including other blocks, which can facilitate easier storage.

The block can offer three different heights for support from its length, height, and width, providing the human user with various options.

The block may be formed unitarily using any suitable compressible material that can be strong enough to support the weight of a human user.

The compressible material can include known, related art, or later developed material, which may be selected for a variety of factors, including but not limited to weight, resistance to pressure, and durability.

The compressible material of the block can provide various benefits including durability, sturdiness, comfort, and safety.

The material used to unitarily form the block can be lightweight enough for a human user to easily carry, while still being able to support a human user.

The material used to unitarily form the block can be water resistant or waterproof.

The block may constitute a unitary structure. The benefits of a unitary structure can include ease of manufacture, structural sturdiness, and durability.

The block can be solid with only the apertures extending into the interior of the block.

The apertures can provide a human user with a better grip on the block by allowing the user to slot their fingers into the apertures, where the fingers can act similarly to hooks into the interior of the block to secure the grip.

The positioning of the apertures on the opposing sides of the block can make gripping the block easier and can ensure the user does not lose their grip.

The human user can grip the block using the apertures with each hand. The stadium-shaped structure of the apertures can facilitate a firm grip by the user through a combination of the arcuate ends and the dimensions of the apertures.

The human user can also grip the block in other ways, including but not limited to using both hands for a single aperture.

The block can act as a support for other parts of the user's body other than the hands, including but not limited to the head, torso, and legs, which may help facilitate specific exercises.

The block can help support the user's body in specific ways to make certain body positions easier to perform.

The block can be used to help a human user target a particular area for sensation, which can allow for targeting certain muscles to engage or relax. The block can help increase or decrease pressure on certain parts of the body depending on the exercise.

The block can help a human user performing a yoga pose by helping prevent slippage.

The block may additionally be used for aerobic exercises and non-exercise related support purposes, such as elevating a user's legs while they are laying down or providing support while a user is sitting in a chair.

Multiple blocks can be used when performing yoga and other exercises. A user can perform exercises with a block supporting each hand or holding a block in each hand. Stacking multiple blocks in different orientations can provide more variety in heights for support use in exercises.

The block can help the user perform yoga and other exercises, which can provide health benefits.

In some embodiments, the apertures can form a contiguous aperture.

In some embodiments, the block can be fully solid without any apertures extending into the interior of the block.

In some embodiments, the block can have additional apertures on the front, rear, top, and bottom surfaces. In further embodiments, the block can have any combination of apertures on its sides. In still further embodiments, the various apertures can form contiguous apertures.

In some embodiments, the apertures can have various geometric shapes including but not limited to stadium, rectangle, and ellipse.

In some embodiments, the apertures can have varying, non-uniform depths. The apertures can be arcuate and concave when extending into the interior of the block.

In some embodiments, the edges of the block can be rounded.

The apparatus is not limited to constituting a cuboidal block and can additionally extend into other shapes or combinations of shapes beyond a rectangular cuboid.

In some embodiments, the block can be formed with recycled material.

For a particular embodiment, the compressible material can be plastic.

For another embodiment, the compressible material can be rubber.

For a further embodiment, the compressible material can be cork.

For another further embodiment, the compressible material can be foam.

Some of the embodiments are therefore directed to an apparatus configured for assisting a human user to perform yoga. The apparatus can include a block formed unitarily of a material that is subject to compression during use, the block including a rectangle in cross-section. The block can include top and bottom opposing surfaces. The block can also include front and rear opposing surfaces. The block can also include opposing side surfaces each having a length that is substantially the same as a length of the top and bottom surfaces, the opposing side surfaces having a height that is substantially the same as a height of the front and rear surfaces, the length of the top, bottom, and side surfaces being longer than the height of the front, rear, and side surfaces, one of the opposing side surfaces defining an aperture that opposes an aperture of the other of the side surfaces, the apertures extending partially into an interior of the block to a length so as to not form a contiguous aperture.

In some of these embodiments, the length of the block can be between 12 inches and 22 inches.

In some of these embodiments, the length of the block can be between 16 inches and 20 inches.

In some of these embodiments, the length of the block can be approximately 18 inches.

In some of these embodiments, the height of the block can be between 6 inches and 10 inches.

In some of these embodiments, the height of the block can be between 7 inches and 9 inches.

In some of these embodiments, the height of the block can be approximately 8 inches.

In some of these embodiments, the width of the block can be between 10 inches and 14 inches.

In some of these embodiments, the width of the block can be between 11 inches and 13 inches.

In some of these embodiments, the width of the block can be approximately 12 inches.

In some of these embodiments, there is a recess in at least one of the side surfaces.

In some of these embodiments, each recess is centered on its respective side surface.

In some of these embodiments, there are a plurality of recesses in at least one of the side surfaces.

In some of these embodiments, the recesses are located at the corners of their respective side surfaces.

In some of these embodiments, the apertures can be centered on the opposing side surfaces.

In some of these embodiments, the apertures can be arcuate at each end.

In some of these embodiments, the length of the apertures can be between 7 inches and 11 inches.

In some of these embodiments, the length of the apertures can be between 8 inches and 10 inches.

In some of these embodiments, the length of the apertures can be approximately 9 inches.

In some of these embodiments, the width of the apertures can be between 1 inch and 3 inches.

In some of these embodiments, the width of the apertures can be between 1.5 inches and 2.5 inches.

In some of these embodiments, the width of the apertures can be approximately 2 inches.

In some of these embodiments, the depth of the apertures can be between 0.5 inches and 1.5 inches.

In some of these embodiments, the depth of the apertures can be between 0.75 inches and 1.25 inches.

In some of these embodiments, the depth of the apertures can be approximately 1 inch.

In some of these embodiments, the edges of the block can be chamfered.

In some of these embodiments, the block can be lightweight.

In some of these embodiments, the block can be formed of non-slip material.

In some of these embodiments, the block can be water resistant.

In some of these embodiments, the block can be waterproof.

Embodiments are also intended to include or otherwise cover methods of using and methods of manufacturing any or all of the elements disclosed above.

It will be apparent to one skilled in the art that various changes can be made, and equivalents employed, without departing from the scope of the invention.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

Figure 1:
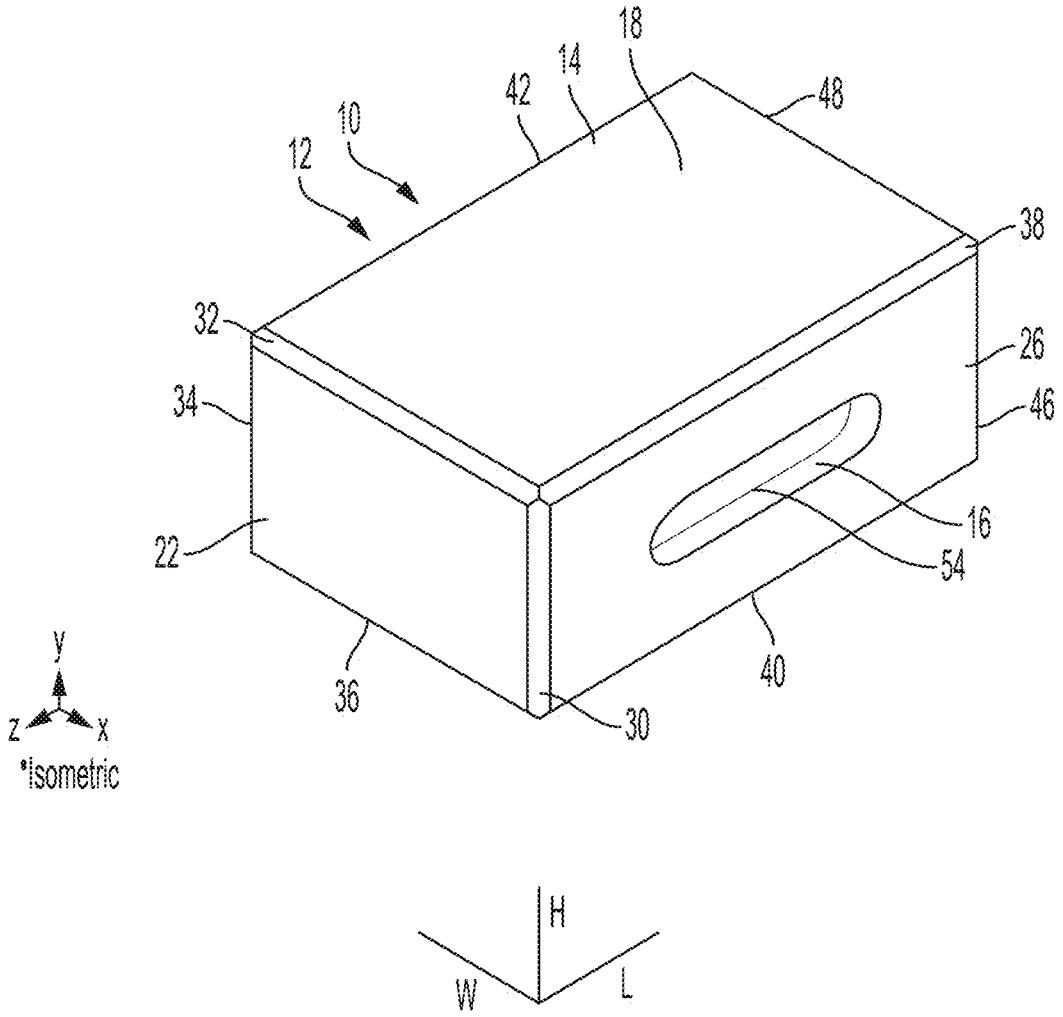
FIG. 1 is a view of an apparatus for support in accordance with the disclosed subject matter for an exemplary embodiment.
Figure 2:
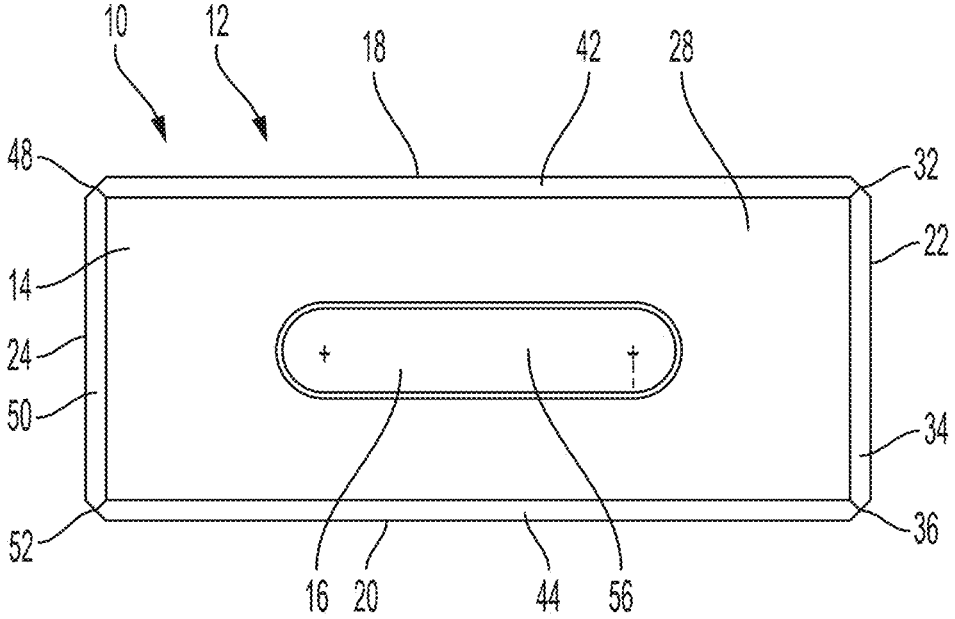
FIG. 2 is a schematic side view of the apparatus of FIG. 1 in accordance with the disclosed subject matter.
Figure 3:
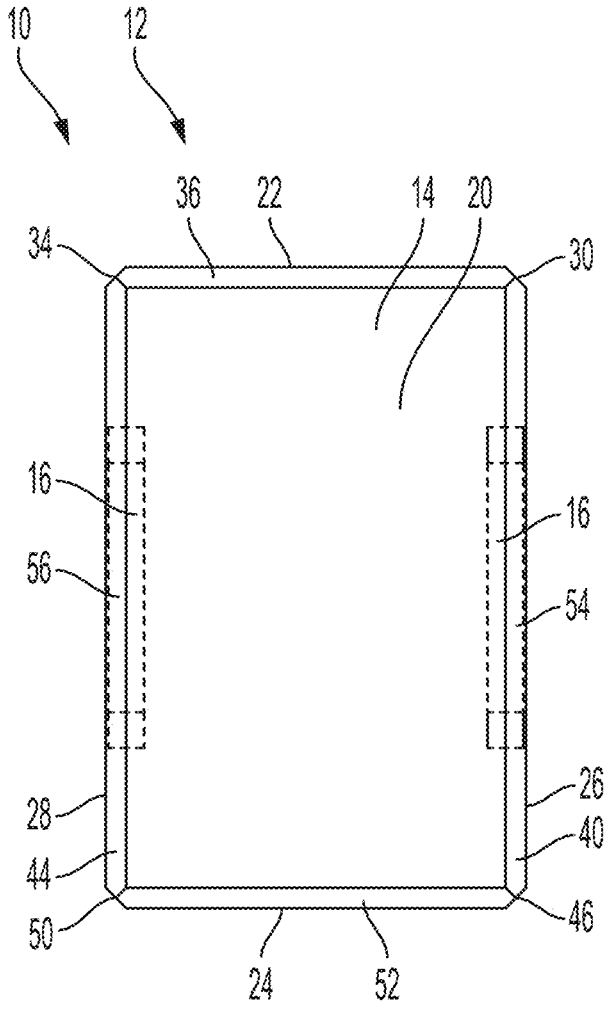
FIG. 3 is a schematic top view of the apparatus of FIG. 1 in accordance with the disclosed subject matter.

The present disclosure includes various support apparatus embodiments configured to assist a human user in performing yoga and other exercises. In FIGS. 1, 2, and 3, an embodiment of an apparatus 10 including a block 12 is shown, where FIG. 1 depicts a view of the block 12, FIG. 2 depicts a side of the block 12, and FIG. 3 depicts a bottom of the block 12.

FIG. 1 shows the block 12 which may include a left aperture 54 and a right aperture 56. The block 12 can include several sides, including a top side 18 and a bottom side 20, also known as the top and bottom opposing surfaces, a front side 22 and a rear side 24, also known as the front and rear opposing surfaces, and a right side 28 and a left side 26, also known as the opposing side surfaces. The sides of the block 12 can each have a rectangular shape, forming a rectangular cuboid in geometrical terms, and therefore the block 12 can include a rectangle in cross-section.

The sides can form edges where adjacent sides connect at right angles, such as a left-front edge 30, a top-front edge 32, a right-front edge 34, a bottom-front edge 36, a left-top edge 38, a left-bottom edge 40, a right-top edge 42, a right-bottom edge 44, a top-rear edge 48, a bottom-rear edge 52, a left-rear edge 46, and a right-rear edge 50.

Each edge can be chamfered to reduce the angularity of each edge. In geometrical terms, this would make the block 12 a slightly chamfered rectangular cuboid due to the original vertices being maintained. The chamfered edges can soften the impact of the block 12 and its edges in the case of intentional or unintentional hard contact with the human user. The chamfered edges can make the block 12 easier and more comfortable for a human user to grip around the edges. The chamfered edges can also make it more comfortable for a human user to apply pressure on the block 12 such as laying on it due to the reduced angularity of the edges. The chamfered edges can give the block 12 a distinctive and aesthetically pleasing appearance.

The right side 28 and the left side 26 can have a length that is substantially the same as a length of the top side 18 and bottom side 20. This can result in the right-top edge 42, right-bottom edge 44, left-top edge 38, and left bottom edge 40 sharing the same length. This length can define the length of the block 12 as a whole.

The right side 28 and the left side 26 can have a height that is substantially the same as a height of the front side 22 and rear side 24. This can result in the right-front edge 34, right-rear edge 50, left-front edge 30, and left-rear edge 46 sharing the same height. This height can define the height of the block 12 as a whole.

The front side 22 and the rear side 24 can have a width that is substantially the same as a width of the top side 18 and bottom side 20. This can result in the top-front edge 32, top-rear edge 48, bottom-front edge 36, and bottom-rear edge 52 sharing the same width. This width can define the width of the block 12 as a whole.

The length, height, and width of the block 12 can be different lengths from one another.

The length of the top side 18, bottom side 20, right side 28, and left side 26 can be longer than the height of the front side 22, rear side 24, right side 28, and left side 26. By extension, the length of the block 12 can be longer than the height of the block 12.

The length of the top side 18, bottom side 20, right side 28, and left side 26 can be longer than the width of the front side 22, rear side 24, top side 18, and bottom side 20. By extension, the length of the block 12 can be longer than the width of the block 12.

The width of the front side 22, rear side 24, top side 18, and bottom side 20 can be longer than the height of the front side 22, rear side 24, right side 28, and left side 26. By extension, the width of the block 12 can be longer than the height of the block 12.

The left aperture 54 can be centered in the left side 26. The right aperture 56 can be centered in the right side 28. The apertures 54 and 56 can be opposed and aligned to one another on the opposing sides 26 and 28. The apertures 54 and 56 can be stadium-shaped and can be arcuate at each end. The arcuate ends of the apertures 54 and 56 can make it more comfortable for a human user to grip compared to angular ends. The apertures 54 and 56 can extend partially into an interior 16 of the block 12 and do not form a contiguous aperture.

FIG. 2 shows the right side 28 of the block 12. The right aperture 56 can be seen centered in the right side 28.

The length of the right side 28 can be approximately 18 inches. The left side 26, top side 18, and bottom side 20 can share the same length as the right side 28. This length can define the length of the block 12 as a whole.

The height of the right side 28 can be approximately 8 inches. The left side 26, front side 22, and rear side 24 can share the same height as the right side 28. This height can define the height of the block 12 as a whole.

The right aperture 56 can be approximately 9 inches in length and approximately 2 inches in width. The left aperture 54 can share the same length and width as the right aperture 56.

FIG. 3 shows the bottom side 20 of the block 12. The apertures 54 and 56 can be seen centered and aligned in the left side 26 and right side 28.

The width of the bottom side 20 can be approximately 12 inches. The top side 18, front side 22, and rear side 24 can share the same width as the bottom side 20. This width can define the width of the block 12 as a whole.

The apertures 54 and 56 can be seen extending partially into the interior 16 of the block 12. The apertures 54 and 56 can have a depth of approximately 1 inch, demonstrating that the apertures 54 and 56 do not form a contiguous aperture.

The block 12 can act as a support apparatus for performing yoga and other exercises. For example, the human user can use their hands to elevate them off the ground during yoga or other exercises, and the block 12 can provide a platform for this purpose. This can also provide a more comfortable hand position than doing the exercises without a support platform.

The size of the block 12 can provide various benefits. The benefits can include but are not limited to a wide surface area for supporting a human user's body and comfortable hand positioning upon a human user holding the block 12 using the apertures 54 and 56. For certain exercises where multiple supports may be used, the size of the block 12 can allow the user to use fewer blocks 12 to achieve a similar effect as compared to a smaller type of support. For example, where a pair of smaller supports may have been used to support a user's knees, a single block 12 can be used instead.

The larger size of the block 12 as compared to related art can make the block 12 more usable by a wide range of human users. A small support block may not be feasible to use for larger or heavier users, while a large support such as the block 12 can still be used by smaller users in certain ways. The block 12 can support more weight with its size and wide surface area.

The cuboidal shape of the block 12 can allow it to be placed on any flat surface. The block 12 can be stacked on top of other blocks 12 for ease of storage. The block 12 can stand on any of its sides which can allow it to fit into different spaces depending on orientation. This can also make storing multiple blocks 12 easier as the blocks 12 can be rearranged and reoriented to fit into a particular space.

The block 12 can provide additional height for supporting a human user's body when performing certain exercises, which can allow the user to correctly assume the intended position while remaining comfortable. The block 12 can offer three different heights for support from its length, height, and width, providing the human user with various options. The user can place the block 12 on different sides depending on the height that best serves the exercise.

The block 12 may be formed unitarily using any suitable compressible material that can be strong enough to support the weight of a human user. The block 12 can be compressible when the user puts pressure on the block 12 directly or indirectly. The material can allow for compression of the block 12 which can make the block 12 easier and more comfortable for a human user to grip. When the human user grips or applies pressure to the block 12 during yoga or other exercises, the block 12 can provide support.

The compressible material can include known, related art, or later developed material. The compressible material can be soft for comfort but firm enough to support a human user's body. Examples of suitable material can include but are not limited to plastic, rubber, cork, and foam. The material may be selected for a variety of factors, including but not limited to weight, resistance to pressure, and durability.

The compressible material of the block 12 can provide various benefits compared to using a rigid, uncompressible material. A rigid, uncompressible material may permanently deform or break under pressure, while compressible materials can be less prone to these issues. Similarly, a rigid, uncompressible material can be more likely to receive damage after being dropped or bumped compared to a compressible material. Additionally, it can be more comfortable for a user to put pressure on a softer compressible block than a rigid one. The compressible material can be sturdy enough to withstand sudden pressure from an impact with the block 12. The compressibility of the material can help lessen the impact in the case of intentional or unintentional hard contact with the block 12 with a surface or the human user. This can make it less likely for the user to be harmed if hard contact is made.

The material used to unitarily form the block 12 can be lightweight enough for a human user to easily carry, while still being able to support a human user. The lightweight nature of the block 12 can allow for easy transport. It can also make storage easier, as the block 12 can be placed on top of anything else that can support its weight.

The material used to unitarily form the block 12 can be water resistant or waterproof, which can allow the block 12 to resist absorbing sweat. This can make the block 12 easier to clean.

The block 12 may constitute a unitary structure. The benefits of a unitary structure can include ease of manufacture, structural sturdiness, and durability. The block 12 being made of a unitary material can allow for direct use without assembly, and no individual small parts that may be removed or lost. The unitary material can also project a uniform appearance and tactile texture for the block 12.

The block 12 can be solid with only the apertures 54 and 56 extending into the interior 16 of the block 12. The solid nature of the block 12 can result in increased sturdiness and durability. The solid nature of the block 12 in addition to the unitary compressible nature of the block can make the block 12 able to perform its support functions for regular use over an extended period of time.

The apertures 54 and 56 can provide a human user with a better grip on the block 12 by allowing the user to slot their fingers into the apertures 54 and 56, where the fingers can act similarly to hooks into the interior 16 of the block 12 to secure the grip. The user can gain better leverage while using the apertures 54 and 56 to hold the block 12 than merely holding the block 12 directly from an exterior 14 of the block 12. The better grip can facilitate better support when the human user performs yoga and other exercises.

The positioning of the apertures 54 and 56 on the opposing sides of the block 12 can make gripping the block 12 easier and can ensure the user does not lose their grip. The user's fingers can extend into the apertures 54 and 56 when the user grips the block 12, which can provide a stronger hold on the block 12 than on a block without the apertures. The user's fingers can act similarly to hooks that can ensure a tight grip on the block 12. A firm hold on the block 12 can be useful for yoga and other exercises.

The human user can grip the block 12 using the apertures 54 and 56 with each hand. The stadium-shaped structure of the apertures 54 and 56 facilitate a firm grip by the user through a combination of the arcuate ends and the dimensions of the apertures. The apertures 54 and 56 can be long enough for a user to fit the fingers of both hands lengthwise into a single aperture, and therefore long enough for each hand to fit into its respective aperture. The apertures 54 and 56 can be wide enough for a user to fit their fingers into the apertures. The apertures 54 and 56 provide enough depth for a user to partially fit their fingers into the interior 16 of the block 12 and be able to securely position their fingers so as to maintain a firm grip on the block 12.

The human user can also grip the block 12 in other ways, including but not limited to using both hands for a single aperture. The user may grip the block 12 from the exterior 14 directly without using the apertures 54 and 56, though this may result in a less stable grip. The user may also use the block 12 as a platform for their hands by placing their hands on it without gripping it.

The block 12 may be used in various ways to facilitate yoga and other exercises. The block 12 can act as a support for other parts of the user's body other than the hands, including but not limited to the head, torso, and legs. The block 12 can provide elevation for the user's body or certain parts of the body, which may help facilitate specific exercises. The block 12 may be placed in different orientations such as on its side or against a wall for specific actions. The block 12 can be held by the human user and used similarly to a weight. The block 12 can provide a comfortable support for these various exercises due to its compressible nature.

The block 12 can help support the user's body in specific ways to make certain body positions easier to perform. An example can be the block 12 supporting a user's hands when the user's flexibility makes it difficult for them to touch the ground. Another example can be using the block 12 to raise the user's feet to make it easier to perform a backbending pose. Yet another example can be using the block 12 to elevate the user's pelvis.

The block 12 can be used to help a human user target a particular area for sensation. The support capabilities of the block 12 can allow it to increase or decrease stress in an area. The support provided by the block 12 can allow human users to relax their muscles. The block 12 can also help reduce strain. This can make the poses more accessible and comfortable for the user, which allows the user to hold the pose for more time. In these cases, the block 12 can be positioned under the user to assist in relaxing the user's body. The block 12 can also be placed in such a way that the user engages muscles that normally would not be used.

The block 12 can help a human user performing a yoga pose by helping prevent slippage. The human user can use the block 12 to keep their hands or feet in place while holding a pose. The block 12 can also limit sliding when the human user is using the block 12 to support their body such as sitting on it or using it like a pillow to support their head.

The block 12 may additionally be used for aerobic exercises. The block 12 can act as a weight or counterbalance for certain exercises. The block 12 can assist human users with stretching exercises. The block 12 can be used for non-exercise related support purposes, such as elevating a user's legs while they are laying down or providing support while a user is sitting in a chair. The block 12 can be comfortable for human users to sit or lay on and can be used similarly to a cushion or a pillow.

Multiple blocks 12 can be used when performing yoga and other exercises. A user can perform exercises with a block 12 supporting each hand or holding a block 12 in each hand. These exercises can help the user work on balance. A user can perform push-ups while gripping a block 12 in each hand for a more comfortable hand position as opposed to using the ground. A user may use additional blocks 12 to support other parts of the body such as the back or legs. For example, a human user can use the blocks 12 to help support their legs while working on a pose that only uses their arms to support their body, until they become comfortable enough to perform the pose without the extra support. Even then, the block 12 can serve to support experienced users in relaxing certain muscles that would not be possible without the external support. Stacking multiple blocks in different orientations can provide more variety in heights for support use in exercises.

The block 12 can help the user perform yoga and other exercises, which can provide health benefits. The block 12 can help the human user relax and reduce stress while performing yoga. The exercise from performing the yoga can help build the user's strength and balance. The ease of use of the block 12 may motivate the user to perform more yoga poses in different body positions, which can allow the user to work on different muscles. The block 12 can serve as a safety net for certain poses, allowing the user to go deeper into a pose while still having support.

Figure 4:
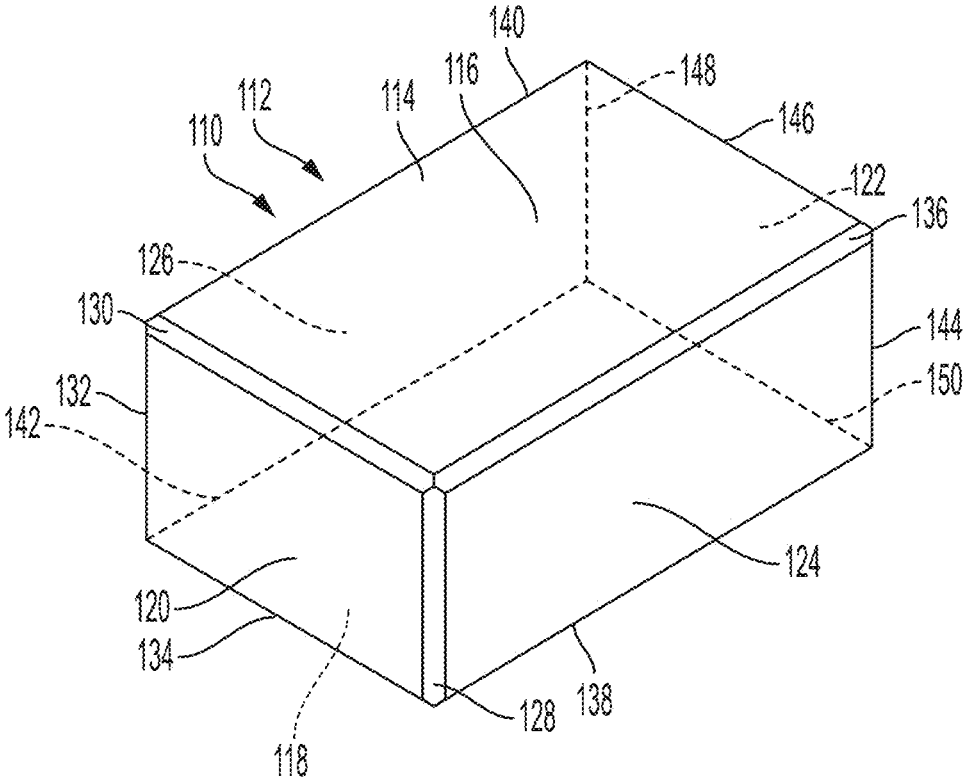
FIG. 4 is a view of an apparatus for support in accordance with the disclosed subject matter for another exemplary embodiment.

In FIG. 4, another embodiment of an apparatus 110 including a block 112 is shown.

FIG. 4 shows the block 112 which can include several sides, including a top side 116 and a bottom side 118, also known as the top and bottom opposing surfaces, a front side 120 and a rear side 122, also known as the front and rear opposing surfaces, and a right side 126 and a left side 124, also known as the opposing side surfaces. The sides of the block 112 can each have a rectangular shape, forming a rectangular cuboid in geometrical terms, and therefore the block 112 can include a rectangle in cross-section.

The sides can form edges where adjacent sides connect at right angles, such as a left-front edge 128, a top-front edge 130, a right-front edge 132, a bottom-front edge 134, a left-top edge 136, a left-bottom edge 138, a right-top edge 140, a right-bottom edge 142, a top-rear edge 146, a bottom-rear edge 150, a left-rear edge 144, and a right-rear edge 148.

Each edge can be chamfered to reduce the angularity of each edge. In geometrical terms, this would make the block 112 a slightly chamfered rectangular cuboid due to the original vertices being maintained. The chamfered edges can soften the impact of the block 112 and its edges in the case of intentional or unintentional hard contact with the human user. The chamfered edges can make the block 112 easier and more comfortable for a human user to grip around the edges. The chamfered edges can also make it more comfortable for a human user to apply pressure on the block 112 such as laying on it due to the reduced angularity of the edges. The chamfered edges can give the block 112 a distinctive and aesthetically pleasing appearance.

The right side 126 and the left side 124 can have a length that is substantially the same as a length of the top side 116 and bottom side 118. This can result in the right-top edge 140, right-bottom edge 142, left-top edge 136, and left bottom edge 138 sharing the same length. This length can define the length of the block 112 as a whole.

The right side 126 and the left side 124 can have a height that is substantially the same as a height of the front side 120 and rear side 122. This can result in the right-front edge 132, right-rear edge 148, left-front edge 128, and left-rear edge 144 sharing the same height. This height can define the height of the block 112 as a whole.

The front side 120 and the rear side 122 can have a width that is substantially the same as a width of the top side 116 and bottom side 118. This can result in the top-front edge 130, top-rear edge 146, bottom-front edge 134, and bottom-rear edge 150 sharing the same width. This width can define the width of the block 112 as a whole.

The length, height, and width of the block 112 can be different lengths from one another.

The length of the top side 116, bottom side 118, right side 126, and left side 124 can be longer than the height of the front side 120, rear side 122, right side 126, and left side 124. By extension, the length of the block 112 can be longer than the height of the block 112.

The length of the top side 116, bottom side 118, right side 126, and left side 124 can be longer than the width of the front side 120, rear side 122, top side 116, and bottom side 118. By extension, the length of the block 112 can be longer than the width of the block 112.

The width of the front side 120, rear side 122, top side 116, and bottom side 118 can be longer than the height of the front side 120, rear side 122, right side 126, and left side 124. By extension, the width of the block 112 can be longer than the height of the block 112.

The length of the right side 126 can be approximately 18 inches. The left side 124, top side 116, and bottom side 118 can share the same length as the right side 126. This length can define the length of the block 112 as a whole.

The height of the right side 126 can be approximately 8 inches. The left side 124, front side 120, and rear side 122 can share the same height as the right side 126. This height can define the height of the block 112 as a whole.

The width of the bottom side 118 can be approximately 12 inches. The top side 116, front side 120, and rear side 122 can share the same width as the bottom side 118. This width can define the width of the block 112 as a whole.

The block 112 can act as a support apparatus for performing yoga and other exercises. For example, the human user can use their hands to elevate them off the ground during yoga or other exercises, and the block 112 can provide a platform for this purpose. This can also provide a more comfortable hand position than doing the exercises without a support platform.

The size of the block 112 can provide various benefits. The benefits can include but are not limited to a wide surface area for supporting a human user's body and comfortable hand positioning upon a human user holding the block 112. For certain exercises where multiple supports may be used, the size of the block 112 can allow the user to use fewer blocks 112 to achieve a similar effect as compared to a smaller type of support. For example, where a pair of smaller supports may have been used to support a user's knees, a single block 112 can be used instead.

The larger size of the block 112 as compared to related art can make the block 112 more usable by a wide range of human users. A small support block may not be feasible to use for larger or heavier users, while a large support such as the block 112 can still be used by smaller users in certain ways. The block 112 can support more weight with its size and wide surface area.

The cuboidal shape of the block 112 can allow it to be placed on any flat surface. The block 112 can be stacked on top of other blocks 112 for ease of storage. The block 112 can stand on any of its sides which can allow it to fit into different spaces depending on orientation. This can also make storing multiple blocks 112 easier as the blocks 112 can be rearranged and reoriented to fit into a particular space.

The block 112 can provide additional height for supporting a human user's body when performing certain exercises, which can allow the user to correctly assume the intended position while remaining comfortable. The block 112 can offer three different heights for support from its length, height, and width, providing the human user with various options. The user can place the block 112 on different sides depending on the height that best serves the exercise.

The block 112 may be formed unitarily using any suitable compressible material that can be strong enough to support the weight of a human user. The block 112 can be compressible when the user puts pressure on the block 112 directly or indirectly. The material can allow for compression of the block 112 which can make the block 112 easier and more comfortable for a human user to grip. When the human user grips or applies pressure to the block 112 during yoga or other exercises, the block 112 can provide support.

The compressible material can include known, related art, or later developed material. The compressible material can be soft for comfort but firm enough to support a human user's body. Examples of suitable material can include but are not limited to plastic, rubber, cork, and foam. The material may be selected for a variety of factors, including but not limited to weight, resistance to pressure, and durability.

The compressible material of the block 112 can provide various benefits compared to using a rigid, uncompressible material. A rigid, uncompressible material may permanently deform or break under pressure, while compressible materials can be less prone to these issues. Similarly, a rigid, uncompressible material can be more likely to receive damage after being dropped or bumped compared to a compressible material. Additionally, it can be more comfortable for a user to put pressure on a softer compressible block than a rigid one. The compressible material can be sturdy enough to withstand sudden pressure from an impact with the block 112. The compressibility of the material can help lessen the impact in the case of intentional or unintentional hard contact with the block 112 with a surface or the human user. This can make it less likely for the user to be harmed if hard contact is made.

The material used to unitarily form the block 112 can be lightweight enough for a human user to easily carry, while still being able to support a human user. The lightweight nature of the block 112 can allow for easy transport. It can also make storage easier, as the block 112 can be placed on top of anything else that can support its weight.

The material used to unitarily form the block 112 can be water resistant or waterproof, which can allow the block 112 to resist absorbing sweat. This can make the block 112 easier to clean.

The block 112 may constitute a unitary structure. The benefits of a unitary structure can include ease of manufacture, structural sturdiness, and durability. The block 112 being made of a unitary material can allow for direct use without assembly, and no individual small parts that may be removed or lost. The unitary material can also project a uniform appearance and tactile texture for the block 112.

The block 112 can be solid. The solid nature of the block 112 can result in increased sturdiness and durability. The solid nature of the block 12 in addition to the unitary compressible nature of the block can make the block 112 able to perform its support functions for regular use over an extended period of time.

The user may grip the block 112 from the exterior 114. The user may also use the block 112 as a platform for their hands by placing their hands on it without gripping it.

The block 112 may be used in various ways to facilitate yoga and other exercises. The block 112 can act as a support for other parts of the user's body other than the hands, including but not limited to the head, torso, and legs. The block 112 can provide elevation for the user's body or certain parts of the body, which may help facilitate specific exercises. The block 112 may be placed in different orientations such as on its side or against a wall for specific actions. The block 112 can be held by the human user and used similarly to a weight. The block 112 can provide a comfortable support for these various exercises due to its compressible nature.

The block 112 can help support the user's body in specific ways to make certain body positions easier to perform. An example can be the block 112 supporting a user's hands when the user's flexibility makes it difficult for them to touch the ground. Another example can be using the block 112 to raise the user's feet to make it easier to perform a backbending pose. Yet another example can be using the block 112 to elevate the user's pelvis.

The block 112 can be used to help a human user target a particular area for sensation. The support capabilities of the block 112 can allow it to increase or decrease stress in an area. The support provided by the block 112 can allow human users to relax their muscles. The block 112 can also help reduce strain. This can make the poses more accessible and comfortable for the user, which allows the user to hold the pose for more time. In these cases, the block 112 can be positioned under the user to assist in relaxing the user's body. The block 112 can also be placed in such a way that the user engages muscles that normally would not be used.

The block 112 can help a human user performing a yoga pose by helping prevent slippage. The human user can use the block 112 to keep their hands or feet in place while holding a pose. The block 112 can also limit sliding when the human user is using the block 112 to support their body such as sitting on it or using it like a pillow to support their head.

The block 112 may additionally be used for aerobic exercises. The block 112 can act as a weight or counterbalance for certain exercises. The block 112 can assist human users with stretching exercises. The block 112 can be used for non-exercise related support purposes, such as elevating a user's legs while they are laying down or providing support while a user is sitting in a chair. The block 112 can be comfortable for human users to sit or lay on and can be used similarly to a cushion or a pillow.

Multiple blocks 112 can be used when performing yoga and other exercises. A user can perform exercises with a block 112 supporting each hand or holding a block 112 in each hand. These exercises can help the user work on balance. A user can perform push-ups while gripping a block 112 in each hand for a more comfortable hand position as opposed to using the ground. A user may use additional blocks 112 to support other parts of the body such as the back or legs. For example, a human user can use the blocks 112 to help support their legs while working on a pose that only uses their arms to support their body, until they become comfortable enough to perform the pose without the extra support. Even then, the block 112 can serve to support experienced users in relaxing certain muscles that would not be possible without the external support. Stacking multiple blocks in different orientations can provide more variety in heights for support use in exercises.

The block 112 can help the user perform yoga and other exercises, which can provide health benefits. The block 112 can help the human user relax and reduce stress while performing yoga. The exercise from performing the yoga can help build the user's strength and balance. The ease of use of the block 112 may motivate the user to perform more yoga poses in different body positions, which can allow the user to work on different muscles. The block 112 can serve as a safety net for certain poses, allowing the user to go deeper into a pose while still having support.

Figure 5:
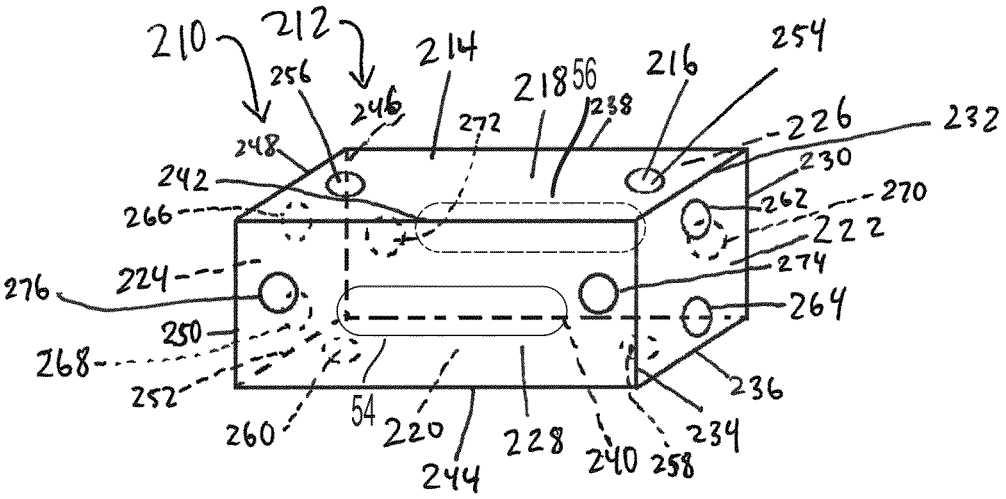
FIG. 5 is a view of an apparatus for support in accordance with the disclosed subject matter for another exemplary embodiment.

In FIG. 5, another embodiment of an apparatus 210 including a block 212 is shown. The block 212 can have an exterior 214 and an interior 216.

FIG. 5 shows the block 212 which can include several sides, including a top side 218 and a bottom side 220, also known as the top and bottom opposing surfaces, a front side 222 and a rear side 224, also known as the front and rear opposing surfaces, and a right side 228 and a left side 226, also known as the opposing side surfaces. The sides of the block 212 can each have a rectangular shape, forming a rectangular cuboid in geometrical terms, and therefore the block 212 can include a rectangle in cross-section.

The sides can form edges where adjacent sides connect at right angles, such as a left-front edge 230, a top-front edge 232, a right-front edge 234, a bottom-front edge 236, a left-top edge 238, a left-bottom edge 240, a right-top edge 242, a right-bottom edge 244, a top-rear edge 248, a bottom-rear edge 252, a left-rear edge 246, and a right-rear edge 250.

Each side of the block 212 can include a plurality of recesses. The top side 218 can include a top-side front recess 254 near the top-front edge 232 and a top-side rear recess 256 near the top-rear edge 248. The bottom side 220 can include a bottom-side front recess 258 near the bottom-front edge 236 and a bottom-side rear recess 260 near the bottom-rear edge 252. The front side 222 can include a front-side top recess 254 near the top-front edge 232 and a front-side bottom recess 256 near the bottom-front edge 236. The rear side 224 can include a rear-side top recess 266 near the top-rear edge 248 and a rear-side bottom recess 268 near the bottom-rear edge 252. The left side 226 can include a left-side front recess 270 near the left-front edge 230 and a left-side rear recess 272 near the left-rear edge 246. The right side 228 can include a right-side front recess 274 near the right-front edge 234 and a right-side rear recess 276 near the right-rear edge 250. The recesses can extend into the interior 216 of the block 212.

Although not shown in FIG. 5, the block 212 can include the apertures from previous embodiments in addition to the plurality of recesses.

The recesses can allow the user to easily move and adjust the positioning of the block 212 with a single finger, for example. This can allow the user to reposition the block 212 without having to potentially lose their pose or balance by grabbing the block 212. The recesses can allow the user to easily turn the block 212 onto any of its sides, which can help when a user wants to use a specific height for a pose or other exercise. In cases where the user can grab the block 212, the recesses can help secure the user's grip.

The recesses can also provide tactile feedback for the user in cases where the user cannot see the block 212. This can allow the user to move and reposition the block 212 even when the user cannot see the block 212. The user can use the recesses to determine proper positioning of the block 212 based on the orientation of the recesses that the user can feel.

Figure 6:
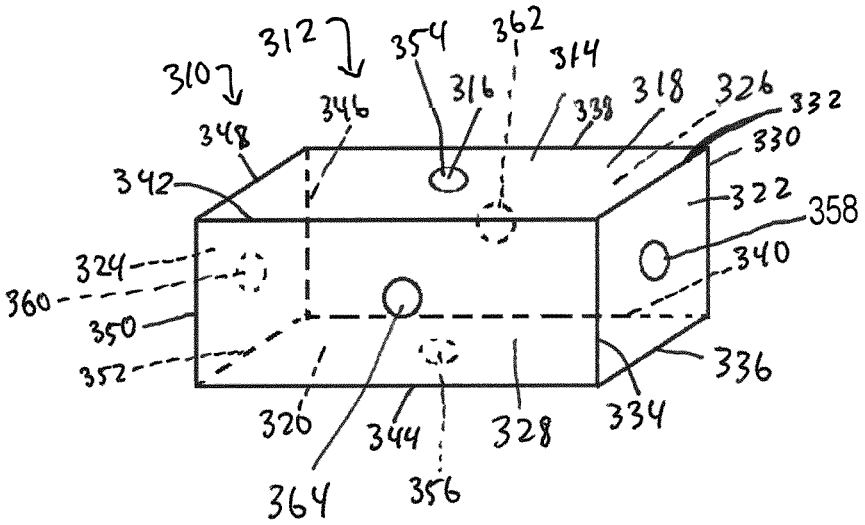
FIG. 6 is a view of an apparatus for support in accordance with the disclosed subject matter for another exemplary embodiment.

In FIG. 6, another embodiment of an apparatus 310 including a block 312 is shown. The block 312 can have an exterior 314 and an interior 316.

FIG. 6 shows the block 312 which can include several sides, including a top side 318 and a bottom side 320, also known as the top and bottom opposing surfaces, a front side 322 and a rear side 324, also known as the front and rear opposing surfaces, and a right side 328 and a left side 326, also known as the opposing side surfaces. The sides of the block 312 can each have a rectangular shape, forming a rectangular cuboid in geometrical terms, and therefore the block 312 can include a rectangle in cross-section.

The sides can form edges where adjacent sides connect at right angles, such as a left-front edge 330, a top-front edge 332, a right-front edge 334, a bottom-front edge 336, a left-top edge 338, a left-bottom edge 340, a right-top edge 342, a right-bottom edge 344, a top-rear edge 348, a bottom-rear edge 352, a left-rear edge 346, and a right-rear edge 350.

Each side of the block 312 can include a centered recess. The top side 318 can include a top recess 354. The bottom side 320 can include a bottom recess 356. The front side 322 can include a front recess 358. The rear side 324 can include a rear recess 360. The left side 326 can include a left recess 362. The right side 328 can include a right recess 364. The recesses can extend into the interior 316 of the block 312.

Although not shown in FIG. 6, the block 312 can include the apertures from previous embodiments in addition to the recesses.

The recesses can allow the user to easily move and adjust the positioning of the block 312 with a single finger, for example. This can allow the user to reposition the block 312 without having to potentially lose their pose or balance by grabbing the block 312. The recesses can allow the user to easily turn the block 312 onto any of its sides, which can help when a user wants to use a specific height for a pose or other exercise. In cases where the user can grab the block 312, the recesses can help secure the user's grip.

The recesses can also provide tactile feedback for the user in cases where the user cannot see the block 312. This can allow the user to move and reposition the block 312 even when the user cannot see the block 312. The user can use the recesses to determine proper positioning of the block 312 based on the orientation of the recesses that the user can feel.

Aspects of Additional Embodiments

The size of the block 12 can vary. The length, width, and height of the block 12 can vary in size, as well as the length, width, and depth of the apertures 54 and 56.

In some embodiments, the length of the block 12 can range between 12 inches and 22 inches. In other embodiments, the length of the block 12 can range between 16 inches and 20 inches. In further embodiments, the length of the block 12 can be approximately 18 inches.

In some embodiments, the height of the block 12 can range between 6 inches and 10 inches. In other embodiments, the height of the block 12 can range between 7 inches and 9 inches. In further embodiments, the height of the block 12 can be approximately 8 inches.

In some embodiments, the width of the block 12 can range between 10 inches and 14 inches. In other embodiments, the width of the block 12 can range between 11 inches and 13 inches. In further embodiments, the width of the block 12 can be approximately 12 inches.

In some embodiments, the length of the apertures 54 and 56 can range between 7 inches and 11 inches. In other embodiments, the length of the apertures 54 and 56 can range between 8 inches and 10 inches. In further embodiments, the length of the apertures 54 and 56 can be approximately 9 inches.

In some embodiments, the width of the apertures 54 and 56 can range between 1 inch and 3 inches. In other embodiments, the width of the apertures 54 and 56 can range between 1.5 inches and 2.5 inches. In further embodiments, the width of the apertures 54 and 56 can be approximately 2 inches.

In some embodiments, the depth of the apertures 54 and 56 can range between 0.5 inches and 1.5 inches. In other embodiments, the depth of the apertures 54 and 56 can range between 0.75 inches and 1.25 inches. In further embodiments, the depth of the apertures 54 and 56 can be approximately 1 inch.

In some embodiments, the apertures 54 and 56 can form a contiguous aperture. The contiguous aperture can run through the middle of the block 12, resulting in a hollowed-out section of the block 12.

In some embodiments, the block 12 can be fully solid without any apertures extending into the interior 16 of the block 12.

In some embodiments, the block 12 can have additional apertures on the front side 22, rear side 24, top side 18, and bottom side 20. In further embodiments, the block 12 can have any combination of apertures on its sides. In still further embodiments, the various apertures can form contiguous apertures.

In some embodiments, the apertures 54 and 56 can have various geometric shapes including but not limited to stadium, rectangle, and ellipse.

In some embodiments, the apertures can have varying, non-uniform depths. The apertures can be arcuate and concave when extending into the interior 16 of the block 12.

In some embodiments, the block 12 can have a single recess on at least one of the sides. The recesses can be located anywhere on their respective side surface, including placements such as in the center of the side, near the edges, or near each corner.

In some embodiments, the block 12 can have a plurality of recesses on at least one of the sides. The recesses can be located anywhere on their respective side surface, including placements such as in the center of the side, near the edges, or near each corner.

In some embodiments, the recess can have various geometric shapes including but not limited to stadium, rectangle, and ellipse. The recess can have varying, non-uniform depths. The recess can be formed of slip resistant material to allow for better grip.

In some embodiments, the recesses of the plurality of recesses can be non-uniform in size, shape, or texture. Additionally, the recesses can be oriented to align with the shape and positioning of a user's fingers.

In some embodiments, the edges of the block 12 can be rounded. This can serve a similar purpose to the chamfered edges of other embodiments, making the block 12 more comfortable to use and hold.

The apparatus 10 is not limited to constituting a cuboidal block and can additionally extend into other shapes or combinations of shapes beyond a rectangular cuboid. The apparatus 10 may include a cuboid with additional extensions that modify the shape. The apparatus 10 can have triangular or rounded ends but is not limited to those shapes. The apparatus 10 can have angled sides to form a ramp which can be useful for yoga and other exercises.

Embodiments of the presently disclosed subject matter can help support a human user in performing physical activities including but not limited to yoga and other exercises. Some actions and body positions can be easier and more comfortable to perform with a support apparatus. The support apparatus can assist human users with exercises while remaining simple and comfortable to use. In particular, the size of the support apparatus can allow human users to support more of their body. The support apparatus can be used in multiple ways to provide support for human users.

Embodiments of the presently disclosed subject matter can include apertures on opposing side surfaces which the user may use to grip the apparatus better. The apertures can be centered on their respective side surface and can have arcuate ends. The design of the apertures can allow human users to comfortably place their fingers into the apertures to ensure proper grip of the apparatus.

Embodiments of the presently disclosed subject matter can include recesses on at least one of the side surfaces that can allow human users to move and reposition the apparatus without grabbing it. The recesses can have a variety of configurations, such as being located at each corner of the at least one side surface. There may be a single recess or a plurality of recesses on at least one of the side surfaces.

Embodiments of the presently disclosed subject matter can be unitarily formed of any material that can be strong enough to support the weight of a human user.

Embodiments of the presently disclosed subject matter can be unitarily formed of a compressible material that can be strong enough to support the weight of a human user.

Embodiments of the presently disclosed subject matter can be formed with recycled material.

Embodiments of the presently disclosed subject matter can be formed with water resistant or waterproof material. This can allow the support apparatus to resist absorbing sweat.

Embodiments of the presently disclosed subject matter can be designed to be lightweight. This can allow human users to easily carry and transport the support apparatus.

Embodiments of the presently disclosed subject matter can be designed to have a nonslip surface. This can provide the support apparatus with better grip, preventing it from sliding around, and can assist human users in firmly applying pressure to or holding the support apparatus.

For a particular embodiment, the compressible material can be plastic. The plastic block can be compressible and lightweight. The plastic material can be sufficiently non-slip which can assist users in gripping the block and keep the block from sliding around.

For another embodiment, the compressible material can be rubber. The rubber block can be compressible and lightweight. The rubber block can reduce the chance of static discharge due to the properties of rubber as a poor conductor of electricity. The rubber material can be sufficiently non-slip which can assist users in gripping the block and keep the block from sliding around.

For a further embodiment, the compressible material can be cork. The cork block can be compressible and lightweight. The cork block can resist absorbing sweat due to the waterproof nature of cork. The cork material can provide a good grip which can assist users in gripping the block and keep the block from sliding around.

For another further embodiment, the compressible material can be foam. The foam block can be compressible and lightweight. The foam material can provide additional comfort when used to support a human user. The foam material can be especially lightweight and can be sufficiently non-slip which can assist users in gripping the block and keep the block from sliding around.

Embodiments are also intended to include or otherwise cover methods of using and methods of manufacturing any or all of the elements disclosed above. The methods of manufacturing include or otherwise cover processors and computer programs implemented by processors used to design various elements of the support apparatus system disclosed above.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. An apparatus configured for assisting a user to perform yoga, the apparatus comprising:

a block formed unitarily of a material that is subject to compression during use, the block including a rectangle in cross-section, the block including:

a top surface;

a bottom surface opposing the top surface;

a front surface;

a rear surface that is of opposing the front surface and which connects to the front surface by a solid interior of the block;

opposing side surfaces each having a length that is substantially the same as a length of the top and bottom surfaces, the opposing side surfaces having a height that is substantially the same as a height of the front and rear surfaces, the length of the top, bottom, and side surfaces being longer than the height of the front, rear, and side surfaces, one of the opposing side surfaces defining a first aperture that opposes a second aperture of the other of the side surfaces, the first aperture and the second aperture extending partially into the solid interior of the block to a length so as to not form a contiguous aperture, wherein the first aperture and the second aperture are separated by the solid interior; wherein the first aperture and the second aperture each have a length, a width, and a depth, the length being greater than the width and the width being greater than the depth;

a plurality of recesses formed of slip resistant material;

a chamfered edge where adjacent surfaces connect; wherein the first aperture is positioned in the center of the one of the opposing side surfaces, the second aperture is positioned in the center of the other of the opposing side surfaces, the plurality of recesses includes a first recess positioned on the one of the opposing side surfaces and a second recess positioned on the one of the opposing side surfaces wherein the first recess and the second recess are positioned with the first aperture therebetween, the plurality of recesses includes a third recess positioned on the other of the opposing side surfaces and a fourth recess positioned on the other of the opposing side surfaces wherein the third recess and the fourth recess are positioned with the second aperture therebetween, the plurality of recesses includes a fifth recess positioned on the top surface and a sixth recess positioned on the top surface, wherein the fifth recess is spaced apart from the sixth recess by a distance that is greater than the length of the first aperture, the plurality of recesses includes a seventh recess positioned on the bottom surface and an eighth recess positioned on the bottom surface, wherein the seventh recess is spaced apart from the eighth recess by a distance that is a greater than the length of the first aperture, the plurality of recesses includes a ninth recess positioned on the front surface and a tenth recess positioned on the front surface, the plurality of recesses includes an eleventh recess positioned on the rear surface and a twelfth recess positioned on the rear surface, the first recess, the second recess, the third recess, and the fourth recess are positioned at a height that is between the eleventh recess and the twelfth recess, and the diameter of each of the plurality of recesses is less than or equal to the width of the first aperture.

2. The apparatus of claim 1, wherein the length of the block is between 12 inches and 22 inches.

3. The apparatus of claim 2, wherein the length of the block is between 16 inches and 20 inches.

4. The apparatus of claim 3, wherein the length of the block is approximately 18 inches.

5. The apparatus of claim 1, wherein the height of the block is between 6 inches and 10 inches.

6. The apparatus of claim 5, wherein the height of the block is between 7 inches and 9 inches.

7. The apparatus of claim 6, wherein the height of the block is approximately 8 inches.

8. The apparatus of claim 1, wherein a width of the block is between 10 inches and 14 inches.

9. The apparatus of claim 8, wherein the width of the block is between 11 inches and 13 inches.

10. The apparatus of claim 9, wherein the width of the block is approximately 12 inches.

11. The apparatus of claim 1, wherein the plurality of recesses are configured to be oriented to algin with the user's fingers.

12. The apparatus of claim 11, wherein the plurality of recesses have varying, non-uniform depths.

13. The apparatus of claim 12, wherein the length of the first aperture and the second aperture is approximately 9 inches.

14. The apparatus of claim 1, wherein the width of the first aperture and the second aperture is between 1 inch and 3 inches.

15. The apparatus of claim 14, wherein the width of the first aperture and the second aperture is approximately 2 inches.

16. The apparatus of claim 1, wherein the first recess, the second recess, the third recess, and the fourth recess are centered along a height on their respective side surface.

17. The apparatus of claim 1, wherein the length of the first aperture and the second aperture is between 7 inches and 11 inches.

18. The apparatus of claim 1, wherein the depth of the first aperture and the second aperture is between 0.5 inches and 1.5 inches.

* * * * *